United States Patent [19]

Knight

[11] Patent Number: 4,576,361

[45] Date of Patent: Mar. 18, 1986

[54] CLAW HAMMER WITH PROTECTIVE CUSHION

[76] Inventor: Alan C. Knight, 243 E. 18th Ave., Columbus, Ohio 43201

[21] Appl. No.: 238,906

[22] Filed: Feb. 27, 1981

[51] Int. Cl.[4] ..... B66F 15/00

[52] U.S. Cl. ..... 254/26 R

[58] Field of Search ..... 145/29 C, 29 R; 254/26; 7/143

[56] References Cited

U.S. PATENT DOCUMENTS

| | | | |
|---|---|---|---|
| 619,608 | 2/1899 | Penny | 254/26 R |
| 1,335,615 | 3/1920 | Small | 254/26 R |
| 1,911,518 | 5/1933 | Lentz | 7/143 |
| 2,527,738 | 10/1950 | Kirk | 254/26 R |
| 2,765,827 | 10/1956 | Hall | 145/29 C |
| 2,879,030 | 3/1959 | Loretitsch | 145/29 R |
| 2,983,297 | 5/1961 | Wilson | 254/26 R |

*Primary Examiner*—Robert C. Watson

*Attorney, Agent, or Firm*—Killworth, Gottman, Hagan & Schaeff

[57] ABSTRACT

A claw hammer having a protective cushion attached to the hammer head so that during normal usage it is in a resting position which will not interfere with the nail driving (or pounding) function of the hammer but at least a portion of the protective cushion is movable into a working position over the bell end of the hammer in order to prevent or minimize damage to the nail bearing surface when the claw end is used for nail pulling. The means facilitating movement of at least a portion of the protective cushion may be either a slide mechanism or a pivot point, such as a hinge, fold or bend. The protective cushion may be made of leather, rubber, synthetic rubber, plastic or other materials.

6 Claims, 9 Drawing Figures

CLAW HAMMER WITH PROTECTIVE CUSHION

BACKGROUND OF THE INVENTION

This invention relates to claw hammers, and more particularly relates to claw hammers having a protective cushion which will prevent or minimize damage to the nail bearing surface when the claw end is being used for nail pulling.

Claw hammers are perhaps the most commonly used tool in the carpentry trade, being used in both rough and finish carpentry. In rough carpentry, any marring of the wood is inconsequential; in finish carpentry, however, no marring of the wood must occur. If a nail is misstruck or faulty, it will bend easily, requiring its removal and replacement. When the claw of the hammer is used to pull such a nail, the pressure of the bell of the hammer on the wood will in all likelihood cause marring.

There are many other instances in which a nail or other object needs to be removed from a surface with as little damage to that surface as possible. A common technique for protecting the surface when the claw end of the hammer is used to remove the nail, is to place a board or other material between the nail bearing surface and the hammer head, if space permits. However, in most instances this is not possible. Further, it is in those instances in which the greatest difficulty is encountered in removing the nail. The more difficult the nail removal, the more likely there will be damage to the nail bearing surface on use of the claw hammer.

Accordingly, it has been proposed to use guards of several types to prevent marring of the nail bearing surface. For example, Wilson in U.S. Pat. No. 2,983,297, Loretitsch in U.S. Pat. No. 2,879,030 and Hall in U.S. Pat. No. 2,765,827 show attachments for claw hammers, one function of which is to permit nails to be pulled without marring the wood. In Loretitsch, the attachment is such that it must be removed when the hammer is used to drive nails or used for other pounding. In Wilson and Hall, on the other hand, the attachment includes a cushioned portion enclosing the bell (striking) end of the hammer head and thereby preventing direct contact of the metal hammer bell end with the surface into which the nail is being driven. An attachment device having only this function is shown in U.S. Pat. No. 800,305 to Kitson. In Wilson, Hall and Kitson, when that function is not desired, the attachment device must be removed. Thus, in all of these prior art devices, the attachment must be removed in order to use the hammer for normal nail driving or else the resilient material of the attachment will eventually be destroyed.

As such, the prior art devices are cumbersome and somewhat of a nuisance. They have found little commercial acceptance in the industry. Accordingly, the need exists for a convenient, non-cumbersome means to prevent or minimize damage to the nail bearing surface when the claw end of the hammer is being used, but which will otherwise not interfere with the normal use of the claw hammer.

SUMMARY OF THE INVENTION

The present invention meets that need by providing a protective cushion which is integral with the hammer head in that it is for the most part permanently attached thereto even though the protective cushion may be replaced when worn. The protective cushion may be moved into a working position to protect the nail bearing surface when the claw end is being used to remove a nail, for example, but is normally retracted to a resting position where it will not interfere with any of the other normal functions of the hammer.

Within these bounds, the form of the protective cushion may vary somewhat. It may be mounted on the hammer head in either a sliding or a pivoted fashion to facilitate movement of at least a portion of the protective cushion into the working position over the bell end of the hammer head. In the slidably mounted embodiment, a variety of track arrangements could be used for that purpose, or it could be a combination of a sliding arrangement and a pivotal one. In the pivoted form, hinged, folded or molded versions and either single or multiple component forms of the protective cushion may be used.

Preferred is a single section hinged protective cushion made of a resilient material such as leather, rubber, synthetic rubber, or plastic. It may be attached by a hinge to a recess formed in the top of the hammer head or it may be attached by a hinge to an edge of the opening in the hammer head which fits over the end of the handle. In the resting position the protective cushion overlaps a portion of the claw end of the hammer head. As such, it is in a non-interfering position during nail driving. In use it is pivoted on the hinge so that it is moved over a portion of the body, neck and bell end of the hammer head. As such it serves as a protection against marring the nail bearing surface during nail pulling.

Accordingly, it is an object of the invention to provide a claw hammer having a convenient, non-cumbersome protective cushion which will prevent or minimize damage to the nail bearing surface when the claw end is used for nail pulling but will not interfere with the nail driving function of the hammer.

Other objects and advantages of the invention will be apparent from the following description, the accompanying drawing and the appended claims.

DETAILED DESCRIPTION OF THE PREFERRED EMBODIMENT

Figure 1:
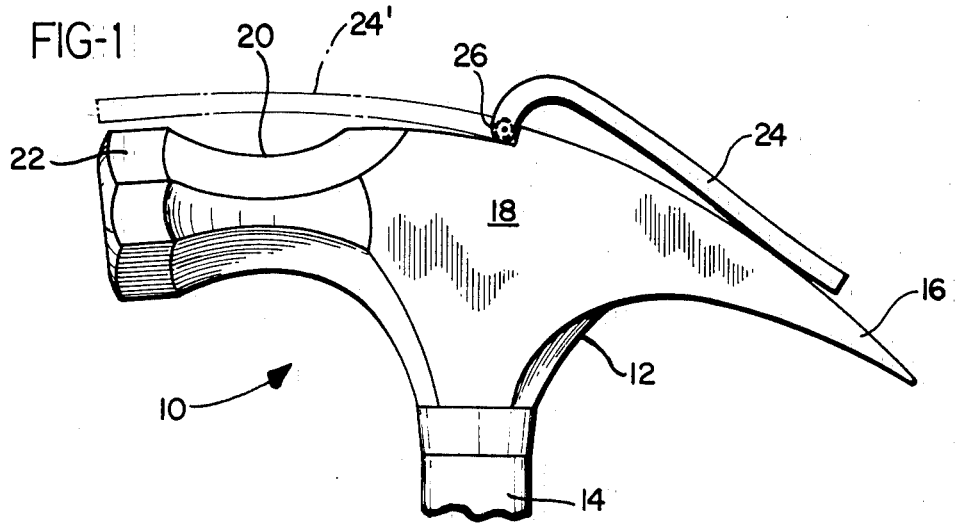
FIG. 1 and 1A illustrate a preferred embodiment (FIG. 1) and a modification of the preferred embodiment (FIG. 1A), showing, respectively, a claw hammer having single section hinged protective cushion and a claw hammer having a two section hinged protective cushion.

Referring the FIGS., there is shown a claw hammer 10 having hammer head 12 and a handle 14. The hammer head has a claw end 16, a body 18, a neck 20 and a bell end 22. In FIG. 1, protective cushion 24 is shown attached to a recess in the top of the hammer head body 18 by hinge 26. Protective cushion 24, thus, extends from near the center of the hammer head 12 to a little over the V of the claw end 16. A catch (not shown) or other releasable attachment means may be used to retain protective cushion 24 in the resting position shown in bold lines in the drawing. This position is used, as mentioned, when the claw hammer 10 is used for nail driving or other pounding functions. It will be appreciated that in this position, the protective cushion 24 will not interfere with the ordinary use of the hammer in this manner.

The nail-pulling position of protective cushion is shown in FIG. 1 in dotted lines as open protective cushion 24'. In that instance open protective cushion 24' is in the working position and extends just beyond the bell end 22 of the hammer head 12, overlying the neck 20 and a portion of the top of the body 18. As is apparent, hinge 26 allows for pivoting of the protective cushion 24 to move it into this working position.

Figure 1A:
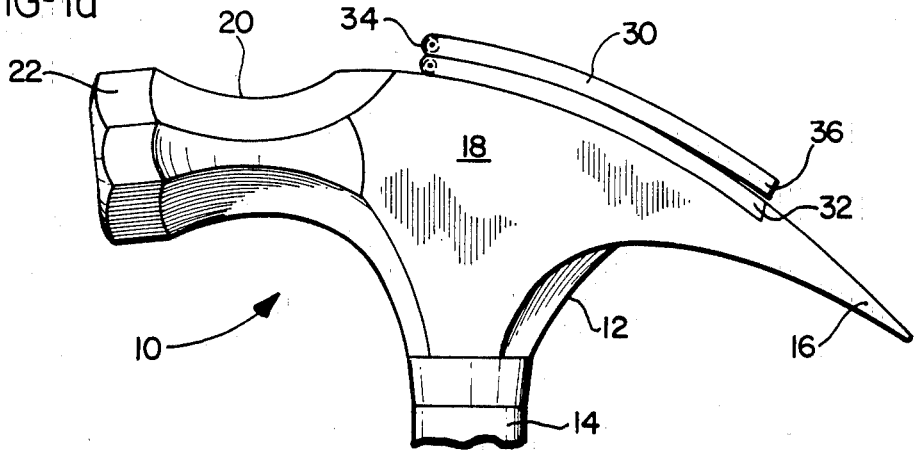

In FIG. 1, protective cushion 24 is a single section or single piece of material. FIG. 1A shows a hinged embodiment, but in this instance a two section protective cushion 30 is used. The first section 32 is attached to the top of hammer head 12 by adhesive or other attachment means. Interlocking hinge 34 joins the second section 36 and forms a pivot about which the second section 36 may be moved to place it in the working position. Again a catch (not shown) or other releasable attachment may be used to retain second section 36 overlying first section 32, as shown, when the protective cushion 30 is in the resting position.

Figure 2:
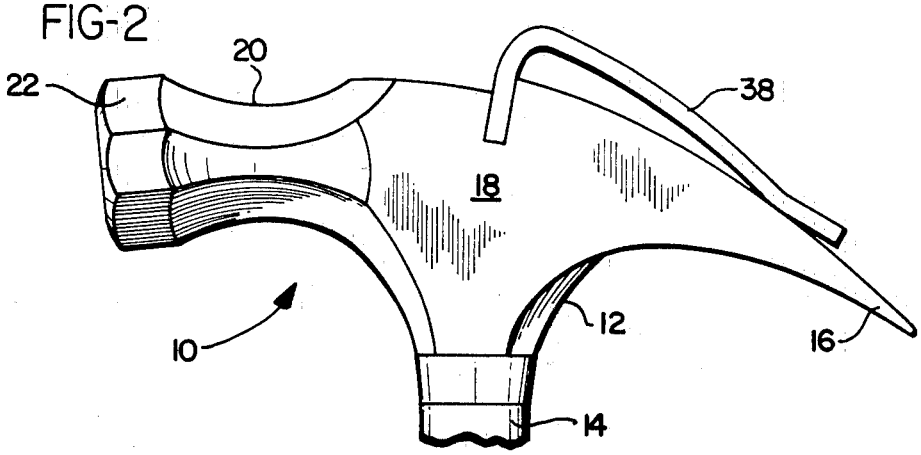
FIG. 2 and 2A are alternative embodiments showing, respectively a claw hammer having a single section folding protective cushion and one having a two section folding protective cushion.
Figure 2A:
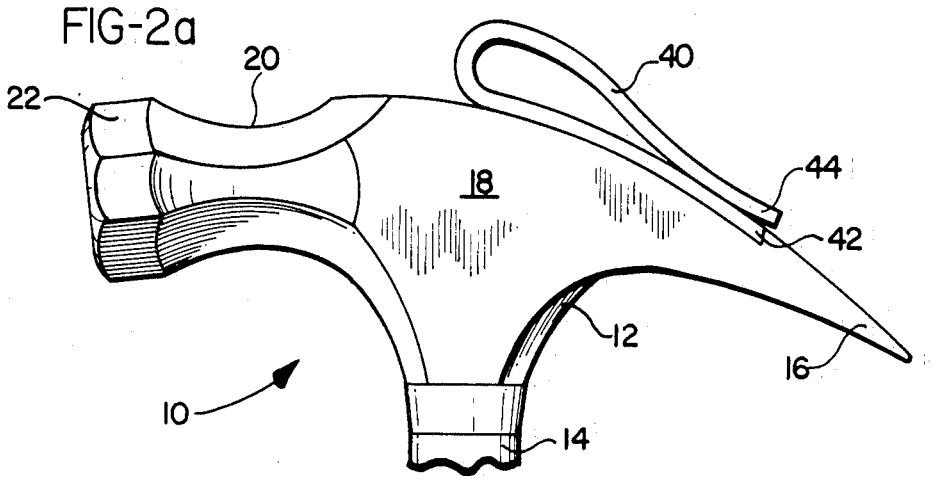

Alternative embodiments are shown in FIGS. 2 and 2A, 3 and 3A, and FIGS. 4–4B. In FIG. 2 a single section folding protective cushion 38 is shown; whereas in FIG. 2A a two section folding protective cushion 40, having sections 42 and 44, is shown. In this embodiment protective cushions 38 and 40 are made of a resilient material which can be folded from the illustrated resting position to the working position (not shown). Such materials include leather, rubber, flexible plastic, etc. This is to be distinguished from the embodiments shown in FIG. 1 and 1A where the protective cushion need not be made of a flexible, foldable material but could be stiff and inflexible such as wood, rigid rubber or plastic, or even metal, if so desired. Otherwise, as in the previous embodiment, a catch or other releasable attachment means (not shown) may be used to retain protective cushion 38 and second section 44 of protective cushion 40 in the resting position. Also in this embodiment, adhesive and/or other bonding means are used to affix the protective cushions 38 and 40 to the top of the body 18 of hammer head 12. Other attachment means could be used as well.

Figure 3:
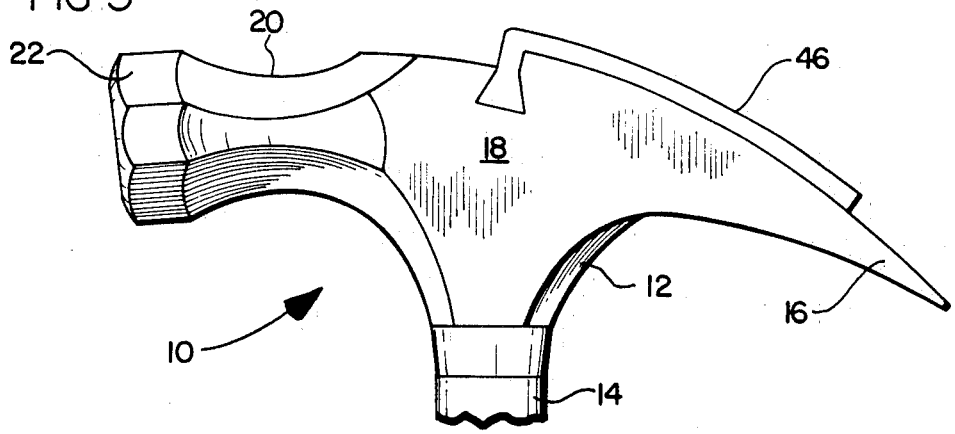
FIG. 3 and 3A are additional alternative embodiments showing, respectively, a claw hammer having a single section molded protective cushion and one having a two section molded protective cushion.
Figure 3A:
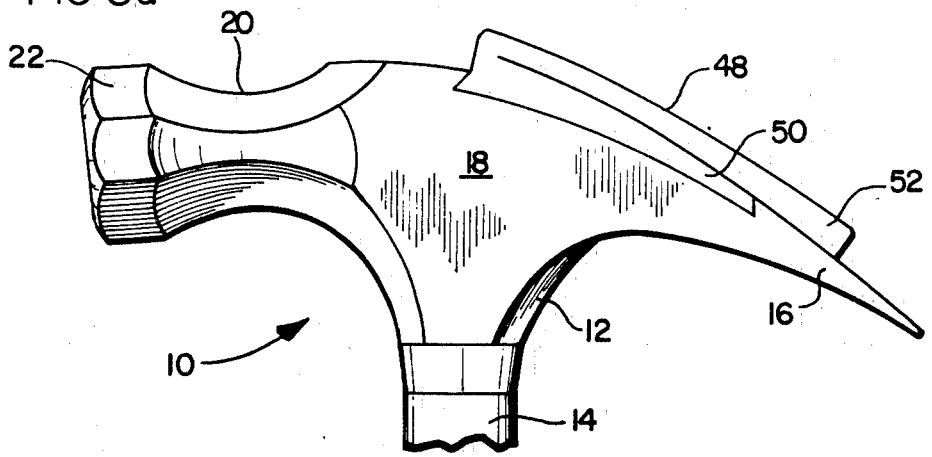

In FIGS. 3 and 3A protective cushions 46 and 48 are made of a molded material which is even more integral with hammer head 12 than the previous embodiments. As in FIGS. 2 and 2A, the molded material must be flexible or bendable so that the protective cushion 46 and second section 52 of protective cushion 48 can be moved from the resting position (shown) to the working position (not shown). A preferred material for the protective cushion 46 or 48 is a rubber, synthetic rubber such as silicone rubber, or other elastomeric materials with an inherent spring action. In this way the protective cushion will return to its normal position—resting position—automatically. If the material should have insufficient spring-back, a catch, reusable adhesive, or other releasable attachment means could be used to retain it in the resting position.

Figure 4:
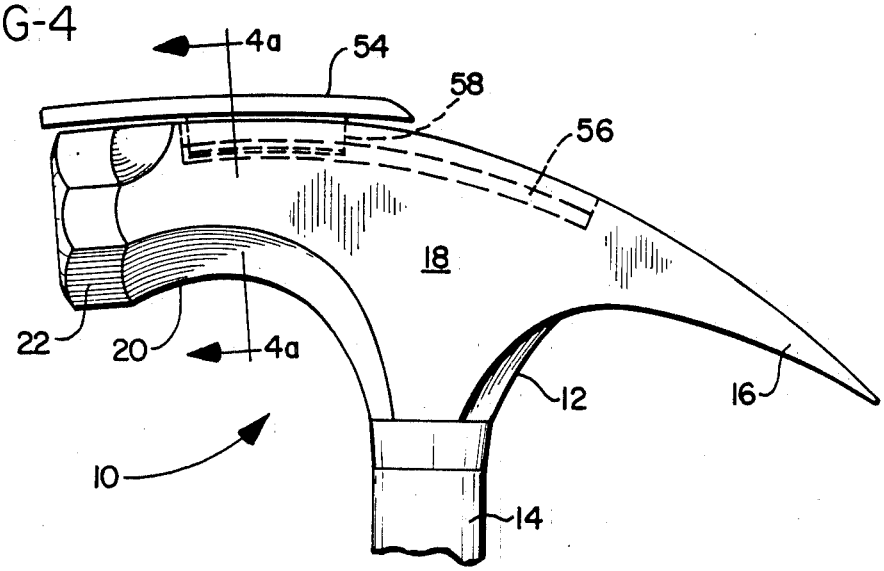
FIG. 4, 4A and 4B illustrate yet another alternative embodiment wherein the claw hammer has a sliding protective cushion.
Figure 4A:
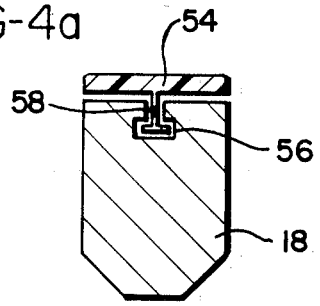
Figure 4B:
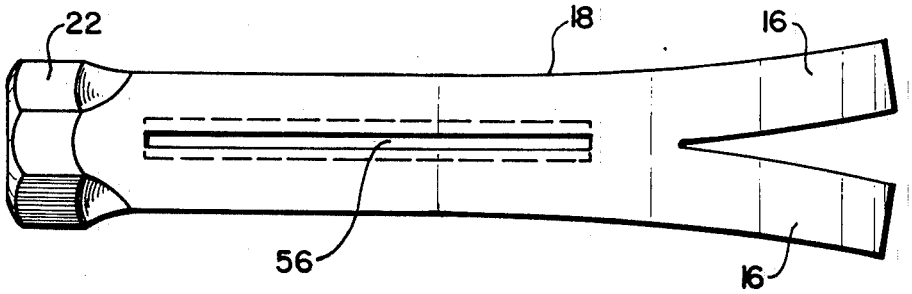

Finally, a slidably mounted embodiment is shown in FIGS. 4–4B. In the form shown, a single section protective cushion 54 has a portion 58 positioned in and slidable over a track formed by T-shaped groove 56 in the hammer head 12. The extent of travel of protective cushion 54 is determined by the length of groove 56. Likewise, retention of the protective cushion 54 in the resting position may be a function of a catch formed as a part of groove 56. Other retention means may also be used as could various other track-type sliding mechanisms. Likewise, a two section protective cushion could also be used wherein one section is slidable into the working position while the other section remains stationary with respect to the hammer head.

In FIGS. 4–4B, as in FIGS. 1 and 1A, the protective cushion need not be made of a foldable or bendable material such as leather, rubber or plastic even though such materials are still preferred in this embodiment. Still even with leather, rubber or plastic, the material in this embodiment should be somewhat rigid to form traveler portion 58 which will function properly in groove 56.

While the article herein described constitutes preferred embodiments of the invention, it is to be understood that the invention is not limited to this precise article, and that changes may be made therein without departing from the scope of the invention.

What is claimed is:

1. A claw hammer having a handle and a hammer head with a claw end and a bell end, said hammer having permanently attached thereto a protective cushion which during nail driving is in a resting position which will not interfere with nail driving but at least a portion of which is readily movable into a working position over said bell end whereby damage to the nail bearing surface is prevented or minimized when said claw end is used for nail pulling and which is retractable from said working position to said resting position, and wherein said protective cushion has a means to pivot at least a portion of said protective cushion to move it into the working position over said bell end.

2. The claw hammer of claim 1 wherein said means to pivot at least a portion of said protective cushion is a hinge.

3. The claw hammer of claim 2 wherein said protective cushion has a single section which is attached to said hammer head by said hinge.

4. The claw hammer of claim 2 wherein said protective cushion has two sections, the first section being attached to said hammer head, and the second section being attached to said first section by said hinge whereby it may be pivoted about said hinge to move said second section into the working position over said bell end.

5. The claw hammer of claim 1 wherein said protective cushion is a flexible, foldable material and said means to pivot at least a portion of said protective cushion is a fold in the flexible, foldable material.

6. The claw hammer of claim 1 wherein said protective cushion is a bendable, molded material and said means to pivot at least a portion of said protective cushion is a bend in the bendable, molded material.

* * * * *